US008540402B2

(12) United States Patent
Guercio et al.

(10) Patent No.: US 8,540,402 B2
(45) Date of Patent: Sep. 24, 2013

(54) LED HOUSING WITH HEAT TRANSFER SINK

(75) Inventors: Vincenzo Guercio, Wallkill, NY (US); Jun Xiang, Parsippany, NJ (US)

(73) Assignee: RAB Lighting Inc., Northvale, NJ (US)

( * ) Notice: Subject to any disclaimer, the term of this patent is extended or adjusted under 35 U.S.C. 154(b) by 237 days.

(21) Appl. No.: 13/112,482

(22) Filed: May 20, 2011

(65) Prior Publication Data

US 2011/0286219 A1 Nov. 24, 2011

Related U.S. Application Data

(60) Provisional application No. 61/347,450, filed on May 23, 2010.

(51) Int. Cl.
*B60Q 1/06* (2006.01)
*F21V 29/00* (2006.01)

(52) U.S. Cl.
USPC ..... 362/373; 362/264; 362/294; 362/345; 257/98; 257/99

(58) Field of Classification Search
USPC ..... 165/80.3; 257/98, 99; 362/218, 362/264, 294, 345, 373, 547
See application file for complete search history.

(56) References Cited

U.S. PATENT DOCUMENTS 6,948,829 B2 9/2005 Verdes et al.
7,549,774 B2 6/2009 Tsai
7,588,359 B2 9/2009 Coushaine et al.
7,800,119 B2 * 9/2010 He et al. ..... 362/373
2007/0242461 A1 10/2007 Reisenauer et al.
2008/0055900 A1 3/2008 Budike, Jr.
2008/0219001 A1 9/2008 Russell
2009/0003009 A1 1/2009 Tessnow et al.
2009/0040065 A1 2/2009 Dalton et al.
2009/0046473 A1 2/2009 Tsai et al.
2009/0052186 A1 2/2009 Xue
2009/0059594 A1 3/2009 Lin
2009/0059595 A1 3/2009 Ge
2009/0103308 A1 4/2009 Xu et al.
2009/0129086 A1 5/2009 Thompson
2009/0147517 A1 6/2009 Li et al.
2009/0147521 A1 6/2009 Zhang et al.
2009/0154160 A1 6/2009 Li et al.
2009/0175037 A1 7/2009 Ewert
2009/0184646 A1 7/2009 Devaney et al.
2009/0262533 A1 10/2009 Liu et al.
2009/0278461 A1 11/2009 Lee et al.
2009/0290344 A1 11/2009 Chiang et al.
2009/0290349 A1 11/2009 Chu et al.

(Continued)

FOREIGN PATENT DOCUMENTS

CA 2541494 7/2007

*Primary Examiner* — Stephen F Husar
(74) *Attorney, Agent, or Firm* — SmithAmundsen LLC; Dennis S. Schell

(57) ABSTRACT

An illustrative thermally managed light includes a light source, for example an LED array, a heatsink having a tapered outer surface, the light source thermally coupled with the heatsink, a housing having a tapered interior surface portion, and a securing device coupling the heatsink and the rear end of the housing. The securing device, for example a tensioning device, adapted to retain the outer surface of the heatsink in thermal contact with the tapered interior surface of the housing, thus transferring and dissipating the heat from the light source into the environment around the housing.

20 Claims, 3 Drawing Sheets

(56) References Cited

U.S. PATENT DOCUMENTS

2009/0296387 A1 12/2009 Reisenauer et al.
2009/0296418 A1 12/2009 Luo et al.
2010/0133578 A1* 6/2010 Pickard et al. ..... 362/373

* cited by examiner

LED HOUSING WITH HEAT TRANSFER SINK

CROSS-REFERENCE TO RELATED APPLICATIONS

This application is a non-provisional of U.S. Provisional Patent Application 61/347,450, filed May 23, 2010, and titled LED HOUSING WITH HEAT TRANSFER SINK, which is entirely incorporated herein by reference.

BACKGROUND

The present invention relates to thermal management for light sources, and particularly, to a heatsink for transferring and dissipating heat from a light source through a light housing.

Managing the temperature of light sources is often important to performance and longevity. This is particularly true when LEDs are used as a light source. LEDs are generally selected to maximize the light output for a given power consumption. Because LED light sources operate at a much lower temperature than typical incandescent light sources, less energy is wasted in the form of heat production. However, LEDs tend to be more sensitive to operating temperature and the lower operating temperatures also provide a much smaller temperature difference between the LED and the ambient environment, thus requiring greater attention to thermal management to transfer and dissipate any excess heat generated by the LED so that the design operating temperature for the LED light source is not exceeded.

As temperatures rise the efficacy of the LED is reduced, reducing the light output. Also, increased operating temperature of the LED reduces the lifespan of the LED. The LED driver is also affected by heat generated by the assembly (LED, driver, external factors). As the temperature rises within the assembly, raising the driver temperature, the lifespan of the driver is adversely affected causing premature failure. Operating at temperatures above the design limits can also cause LEDs to shift in wavelength providing undesirable shifts to the color of the light generated, can damage the LED junction greatly reduce the longevity and performance, and can potentially cause early complete failure of the LED. To facilitate dissipation of heat, it is helpful to increase the surface area available for heat transfer and to transfer the heat generated by the LED to the environment around the light housing. To achieve excellent heat transfer, it is also necessary to ensure that an excellent thermal coupling is provided from the light source to the exterior of the light housing.

SUMMARY

The present invention may comprise one or more of the features recited in the attached claims, and/or one or more of the following features and combinations thereof.

An illustrative thermally managed light includes a light source, for example an LED array, mounted inside a housing. The housing includes a disk-shaped heatsink thermally coupled to the light source. The heatsink has a conically tapered periphery shaped to match a conically tapered interior of the housing. A coupling device, for example a bracket and screw, hold the periphery of the heatsink in thermal contact with the interior of the housing, thus providing a heat transfer path from the light source to the ambient environment around the housing.

An illustrative thermally managed light includes a light source, a disk-shaped heatsink having an annulus with a conical outer surface and a central web spanning at least a portion of the annulus, the light source thermally coupled with the heatsink, a housing having a conical interior surface, a front opening for receiving the light source and the heatsink, and a rear end opposite the opening, and a tensioning device coupling the heatsink and the rear end of the housing. The tensioning device is adapted to retain the conical outer surface of the annulus in thermal contact with the conical interior surface of the housing. The light source can be thermally coupled with the central web of the heatsink. The light source can include at least one LED.

Another illustrative embodiment of a thermally managed light includes a light source, a heatsink having a tapered outer surface, the light source thermally coupled with the heatsink, a housing having an interior surface, at least a portion of the interior surface tapered to receive the tapered outer surface of the heatsink, and a coupling device securing the heatsink with the housing such that the tapered outer surface of the heatsink is thermally coupled with the tapered interior surface of the housing.

In one illustrative embodiment, the coupling device provides tension to the heatsink and is a U-shaped bracket and a screw, the bracket having two ends and a base, the two ends coupled to opposite edges of the heatsink and the base tensioned toward the end of the housing, thus pulling the tapered outer surface of the heatsink in thermal contact with the tapered interior surface of the housing, for example, direct mechanical contact, or only separated by a thermal grease or other thermally conductive material. The interior surface of the housing can be conical and taper inwardly toward the rear end of the housing. The outer surface of the heatsink can be conical and taper inwardly from the side facing the light source to the side facing the rear end of the housing.

The light can further include an LED driver positioned between the heatsink and the rear end of the housing. The LED driver can include a mounting plate coupled between the heat sink and U-shaped bracket. The light can further include a reflector. The light can further include a lens and glare shield. The heat sink can be formed from an aluminum casting. The light can further include a mounting device adjacent the rear end of the housing.

Additional features of the disclosure will become apparent to those skilled in the art upon consideration of the following detailed description of the illustrative embodiment.

BRIEF DESCRIPTION OF THE DRAWINGS

The detailed description particularly refers to the accompanying figures in which.

DESCRIPTION OF THE ILLUSTRATIVE EMBODIMENTS

Figure 1:
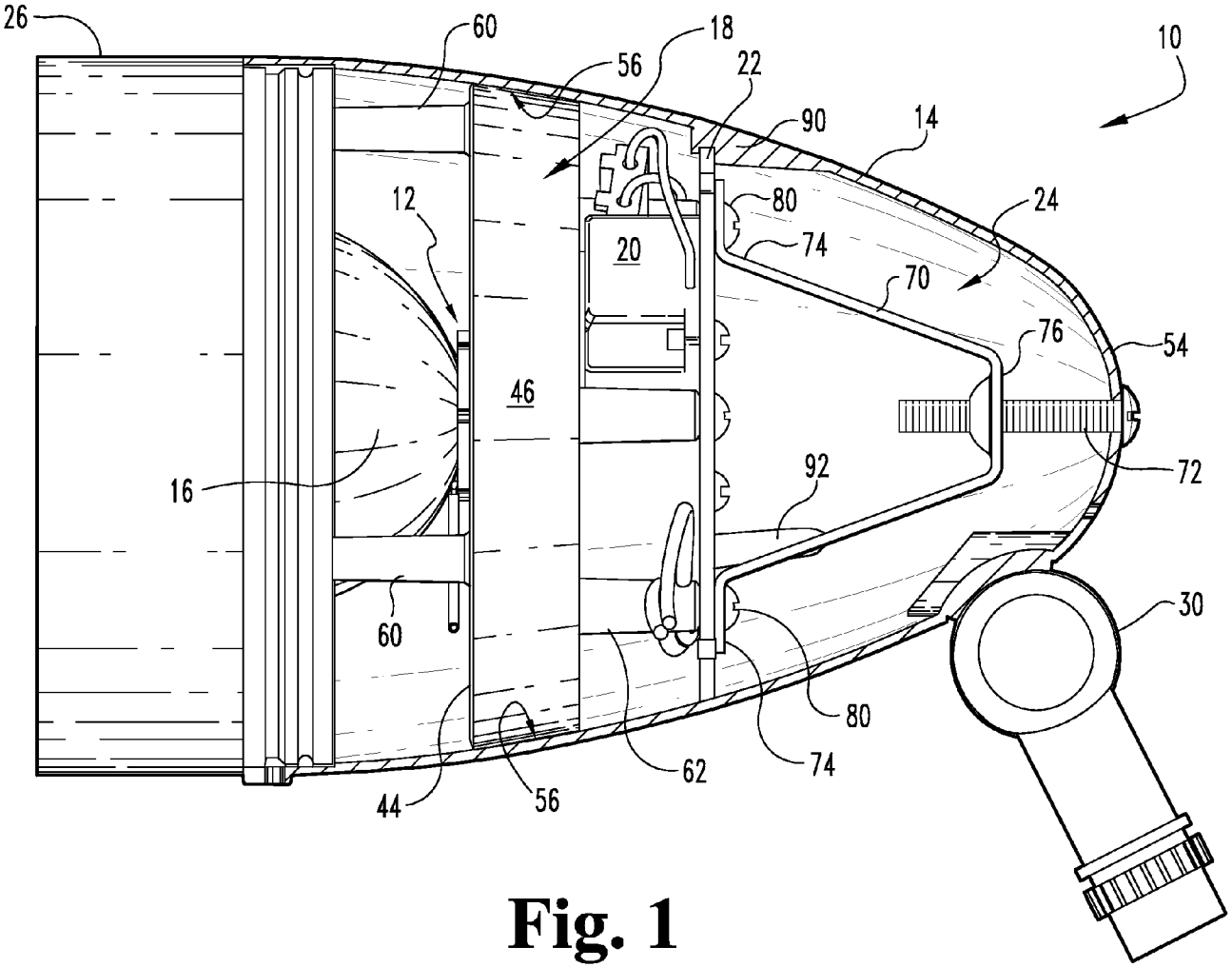
FIG. 1 is a cut-away side assembly view of an illustrative embodiment of a thermally managed light, with the near wall of the light housing shown cut-away.

For the purposes of promoting and understanding the principals of the invention, reference will now be made to one or more illustrative embodiments illustrated in the drawings and specific language will be used to describe the same.

Referring to FIG. 1, an illustrative embodiment of a thermally managed light 10 according to the present disclosure includes a light source 12 mounted inside a housing 14. The light source can be, for example, an LED array having one or more emitting elements. The housing 14 can be bullet-shaped, for example, such as for a flood or spot light used, for example, for lighting landscaping, or other housing shapes known in the art. The housing 14 also encloses a reflector 16, heatsink 18, an LED driver 20 and mounting plate 22, and coupling device 24. The light 10 also can include a glare shield 26, lens 28, and mount 30.

In the illustrative embodiment, the heatsink 18 is disk-shaped and includes an outer rim or annulus 40 and a central web 42 spanning at least a portion of the depth of the annulus. In some embodiments, the heatsink 18 comprises a solid disk rather than having a web spanning a portion of the depth of the outer annulus. The light source 12 is thermally coupled with the heatsink 18, for example, to the front surface 44 of web 42. Thermal coupling may be further facilitated by thermally conductive grease, glue, or other material(s) located between the light source 12 and heatsink 18. The thermal coupling may also be retained by alternative or additional mechanical action, for example by screws 50 securing light source 12 to the heatsink 18. Such thermally conductive materials and mechanical action may also be included at other thermal couplings of the fixture, including those described below. In the illustrative embodiment, the entire heatsink 18 is encapsulated by the housing 14 and other components of the light 10.

The annulus 40 includes an outer surface 46 that is tapered, in this embodiment conically shaped, with a larger diameter toward an opening 52 in the housing 14 and tapering toward a rear end 54 of the housing 14. At least a portion of the housing 14 includes a matching tapered interior surface 56 for mechanically receiving and thermally coupling the outer surface 46 of the heatsink 18, thus facilitating thermal dissipation of the heat transferred from the light source 12 to the housing 14 and into the air or other environment surrounding the housing 14. The interior surface 56 portion of the housing 14 receiving the annulus 40 is similarly sized and tapered to receive the outer surface 46, in this embodiment, conically shaped. Alternatively, the taper of the heatsink 18 and interior surface 56 of the housing 14 can be reversed in that the larger diameter is toward a rear end 54 of housing 14 in embodiments having a rear housing opening for receiving the heatsink 18.

The heatsink 18 may also include standoffs 60 for supporting and/or spacing relative to reflector 16. Such standoffs may optionally be designed to provide heat transfer. The heatsink 18 may also include or couple to standoffs 62 for supporting and/or spacing relative to plate 22, and may similarly optionally be designed to provide heat transfer, and/or to secure heatsink 18 to the housing 14. In the case of the illustrative embodiment of the light 10, standoffs 62 provide the point of mechanically securing coupling device 24 to the heatsink 18, although other points of securing can be used. Additionally, in the illustrative embodiment of light 10, the heatsink 18 has an annulus 40 having a depth greater than the thickness of web 42, thus providing a larger contact area for thermal transfer between the heatsink 18 and the housing 14 than would be provided by the web 42 alone contacting the housing 14.

Figure 2:
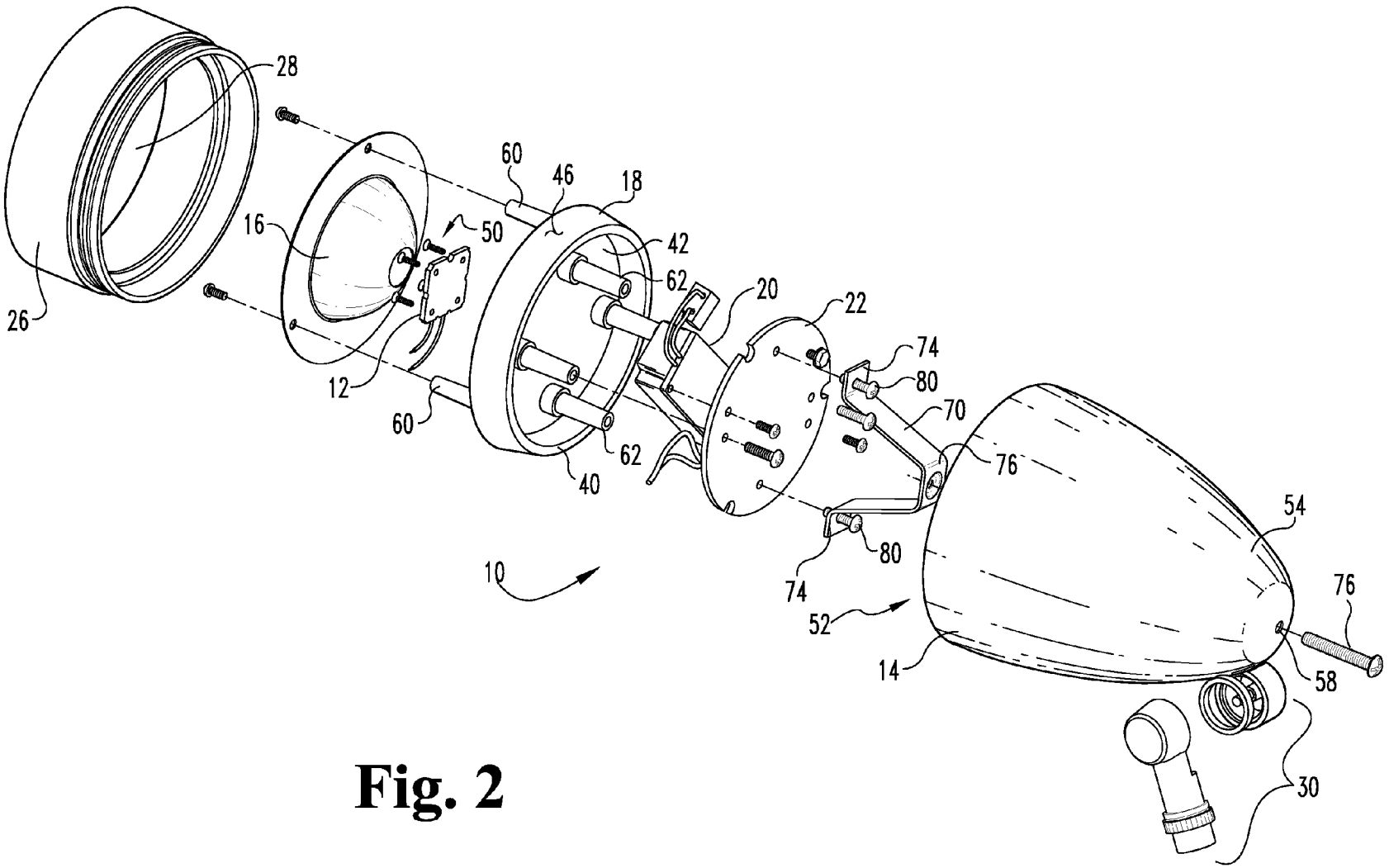
FIG. 2 is an exploded rear view of the thermally managed light of FIG. 1.
Figure 3:
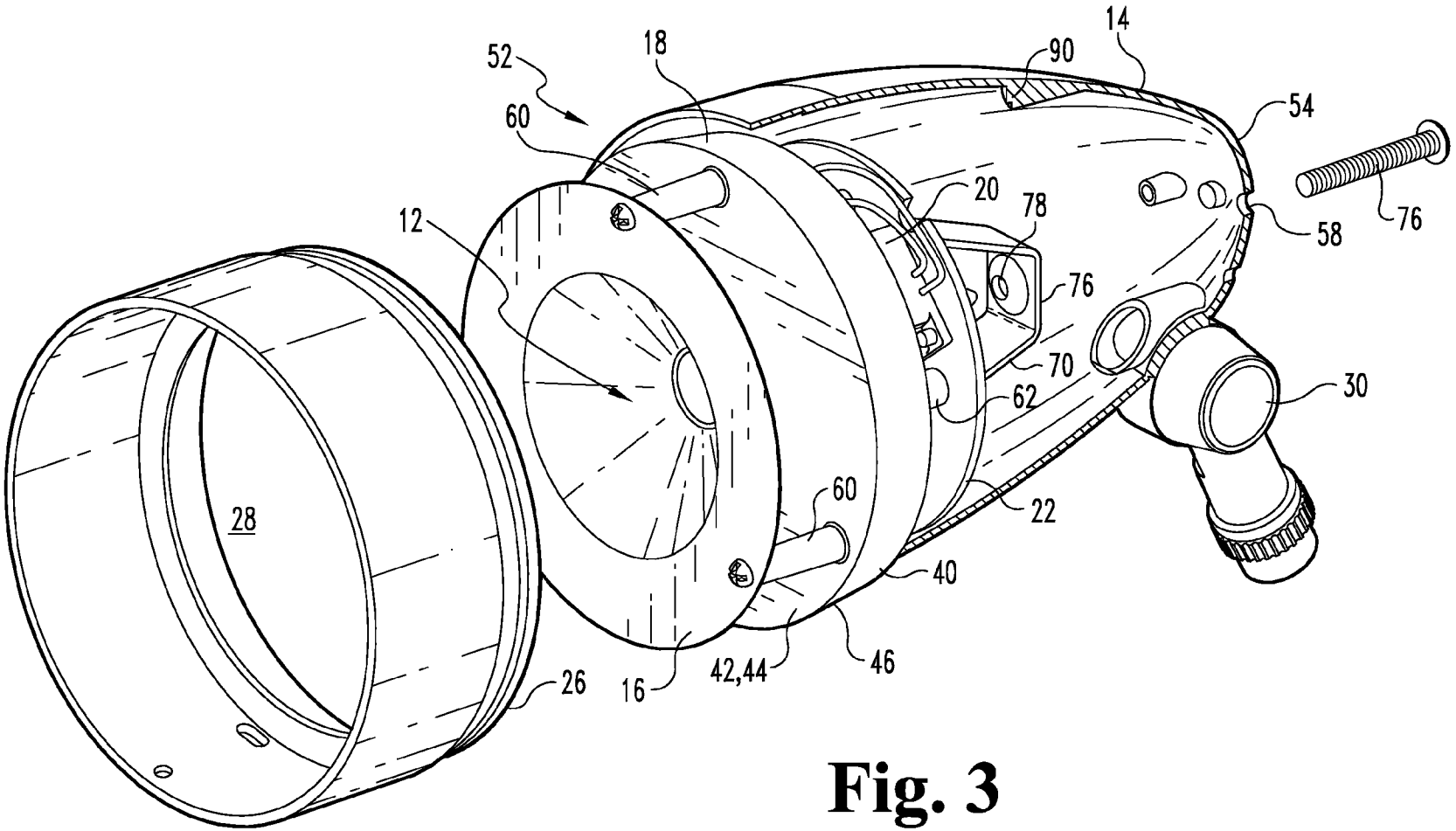
FIG. 3 is a partially exploded front perspective view of the thermally managed light of FIG. 1.

Referring to FIGS. 1 and 2, the coupling device 24 draws the heatsink 18 toward the rear end 54 of the housing 14, thus ensuring thermal coupling of the outer surface 46 of the heatsink 18 with the interior surface 56 of the housing 14. In the illustrative embodiment of the light 10, the coupling device 24 includes a U-shaped bracket 70 and a draw screw 72. The bracket 70 includes two ends 74 and a base 76. The two ends 76 of bracket 70 are coupled to opposite segments of the heatsink 18 via screws 80 secured to standoffs 62. The base 76 of the bracket 70 includes threaded receptacle 78 for receiving and securing the draw screw 76.

As can be understood from the various drawings, the screw 72 passes from outside the housing 14 through opening 58 defined in the rear end 54 of the housing and draws the bracket 70, and thus the heatsink 18, toward the rear end 54 as the screw 72 is threaded further into the receptacle 78. The bracket 70 is sized so that the outer surface 46 of heatsink 18 is drawn securely against the interior surface 56 of the housing 14 before the base 76 of the bracket 70 contacts the housing at the interior at rear end 54. As also can be noted from the various drawings, in the illustrative embodiment of the light 10, the interior of housing 14 lacks any limiting feature blocking the drawing of the heatsink 18 toward the rear end 54 of housing 14 other than the mechanical interference of the outer surface 46 of the heatsink 18 with the interior surface 56 of the housing 14; however, in alternative embodiments, such a feature could be included.

Alternative mechanical means of maintaining thermal contact between heatsink 18 and the interior surface 56 of housing 14 may also be used. For example, coupling device 24 can comprise alternative types of releasable and/or non-releasable fasteners, including, but not limited to a rivet. Alternatively, coupling device 24 may be integral with housing 14 or heatsink 18, for example, a threaded component, the threads of which can be used to tension or press one of housing 14 and heatsink 18 into tight, and therefore thermal, contact with the other, ensuring the entire outer surface 46 of heatsink 18 is in contact with interior surface 56 of housing 14. Additionally, coupling device 24 can be completely contained within the housing 14 with the pressing or drawing of heatsink 18 into housing 14 provided during the manufacturing process, and the coupling device 24 retaining the two in relative position, for example, via a tensioning element of the device 24, for example, a spring. Additionally, or alternatively, one or more screw or other fasteners may extend from the front surface 44 of and through heatsink 18 to secure to an anchor point of the housing 18, such as feature 90, thus drawing heatsink 18 into mechanical and thermal contact with interior surface 56. Additional or alternative coupling devices known in the art may be utilized.

In the illustrative embodiment of light 10, the interior of housing 14 includes positioning features 90 and 92 receiving and stabilizing component plate 22. Additionally, the spacers 62 and optional non-thermally conductive material used for plate 22, for example, typical PCB material, can provide thermal isolation between the light source 12 and the driver 20.

The material used for at least a portion of heatsink 18 is preferably highly thermally conductive, for example aluminum or an alloy. The material used for at least a portion of housing 14 is also preferably highly thermally conductive, for example aluminum, steel, or another alloy. In some embodiments, the exterior surface of housing 14 may include additional features to dissipate heat, for example, fins or other such structures that increase surface are and increase heat dissipation.

While the invention has been illustrated and described in detail in the foregoing drawings and description, the same is to be considered as illustrative and not restrictive in character, it being understood that only illustrative embodiments thereof have been shown and described and that all changes and modifications that come within the spirit and scope of the invention as defined in the claims and summary are desired to be protected.

The invention claimed is:

1. A thermally managed light, comprising:

a light source;

a heatsink having a tapered outer surface, the light source thermally coupled with the heatsink;

a housing having an interior surface, at least a portion of the interior surface tapered to receive the tapered outer surface of the heatsink; and a coupling device securing the heatsink with the housing such that the tapered outer surface of the heatsink is thermally coupled with the tapered interior surface of the housing.

2. The thermally managed light of claim 1, wherein the coupling device secures the outer surface of the heatsink in direct mechanical contact with the tapered portion of the interior surface.

3. A thermally managed light of claim 2, further comprising a thermal grease between the outer surface of the heatsink and the tapered portion of the interior surface.

4. The thermally managed light of claim 2, wherein the coupling device tensions the heatsink to draw the outer surface in thermal contact with the tapered portion of the interior surface.

5. The thermally managed light of claim 2, wherein the coupling device includes a bracket and a fastener coupled between the heatsink and a rear portion of the housing, the fastener accessible from outside the housing.

6. The thermally managed light of claim 2, wherein the coupling device includes a fastener connecting the heatsink to the housing.

7. The thermally managed light of claim 2, wherein the fastener is secured through a hole defined in the heatsink and anchors to a feature of the housing.

8. The thermally managed light of claim 1, wherein the heatsink defines an interior web and an outer annulus, the annulus defining the outer surface having a depth greater than the thickness of the interior web.

9. The thermally managed light of claim 1, wherein the heatsink defines a planar front surface to which the light source is thermally coupled.

10. The thermally managed light of claim 1, further comprising a light reflector and standoffs, and wherein the standoffs at least in part position the reflector relative to the heatsink.

11. The thermally managed light of claim 1, wherein the heatsink is disk-shaped.

12. The thermally managed light of claim 1, wherein the tapered outer surface of the heatsink and the tapered portion of the interior surface of the housing define matching conical surfaces.

13. The thermally managed light of claim 1, wherein:

the housing defines a front opening for receiving the light source and the heatsink; and, the tapers of the outer surface of the heatsink and the portion of the interior surface of the house define a larger diameter toward the light source.

14. The thermally managed light of claim 1, wherein the housing encloses the heatsink.

15. The thermally managed light of claim 1, further comprising an LED driver, and wherein the LED driver is thermally isolated from the light source.

16. The thermally managed light of claim 15, further comprising standoffs, the standoffs at least in part positioning the heatsink relative to the LED driver to define an open space between the two.

17. The thermally managed light of claim 16, further comprising a plate to which the LED driver is coupled, the standoffs coupling the plate and heatsink on a side of the heatsink opposite the light source.

18. The thermally managed light of claim 17, wherein the plate comprises a thermally insulating material.

19. A thermally managed light, comprising:

an LED;

a disk-shaped heatsink having a conical outer surface, the LED thermally coupled with the heatsink;

a housing having an interior surface, at least a portion of the interior surface shaped to receive and match the conical outer surface of the heatsink; and a coupling device securing the heatsink with the housing such that the conical outer surface of the heatsink is thermally coupled with the interior surface of the housing.

20. A thermally managed light, comprising:

a light source;

a heatsink having a tapered outer surface, the light source thermally coupled with the heatsink;

a housing having an interior surface, at least a portion of the interior surface tapered to receive the tapered outer surface of the heatsink; and a coupling device securing the heatsink with the housing such that the tapered outer surface of the heatsink is in direct mechanical and thermal contact with the tapered interior surface of the housing, the coupling device including a bracket and a fastener coupled between the heatsink and a rear portion of the housing, the fastener accessible from outside the housing.

* * * * *